United States Patent [19]

Yoshikawa

[11] 4,320,033

[45] Mar. 16, 1982

[54] SOLID DETERGENT COMPOSITION

[75] Inventor: Susumu Yoshikawa, Yokohama, Japan

[73] Assignee: Lion Corporation, Tokyo, Japan

[21] Appl. No.: 201,837

[22] Filed: Oct. 29, 1980

[30] Foreign Application Priority Data

Oct. 29, 1979 [JP] Japan ..... 54-139477

[51] Int. Cl.[3] ..... C11D 1/75

[52] U.S. Cl. ..... 252/547; 252/528; 252/174; 252/555; 252/DIG. 16

[58] Field of Search ..... 252/547, 528, 555, 174, 252/DIG. 16

[56] References Cited

U.S. PATENT DOCUMENTS 3,332,875 7/1967 Kessler et al. ..... 252/547

4,064,076 12/1977 Klisch ..... 252/555

*Primary Examiner*—Mayer Weinblatt

*Attorney, Agent, or Firm*—Armstrong, Nikaido, Marmelstein & Kubovcik

[57] ABSTRACT

A solid detergent composition, suitable for use in personal hygiene, having improved slough loss and wear rate characteristics is presented. This solid detergent compositions contains:

(A) 40 to 89.9% by weight of at least one linear alpha-olefin sulfonate having 12 to 28 carbon atoms, (B) 10 to 60% by weight of at least one, tertiary amine oxide having general formulae (I) and (II)

(I)

(II)

wherein $R^1$ represents an alkyl group having 16 to 24 carbon atoms, $R^2$ represents an alkyl group having 1 to 11 carbon atoms, $R^3$ represents an alkyl group having 1 to 3 carbon atoms, $R^4$ and $R^5$ independently represent an alkyl group having 12 to 24 carbon atoms and $R^6$ represents an alkyl group having 1 to 3 carbon atoms, and (C) 0.1 to 20% by weight of water.

2 Claims, 2 Drawing Figures

SOLID DETERGENT COMPOSITION

Figure 1:
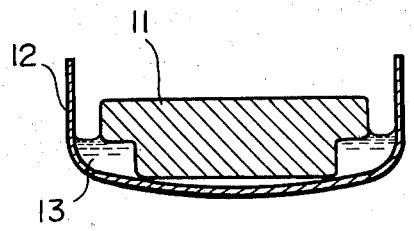

The present invention relates to solid detergent compositions which are suitable for use as bars or cakes for toilet or bath use. More specifically, it relates to synthetic non-soap solid detergent compositions in the form of bars, suitable for use in personal hygiene, having improved slough loss and wear rate characteristics.

Conventional solid detergent compositions heretofore used for personal hygiene are mainly bars or cakes of soap prepared from fatty acid soap derived from fats and oils. However, these conventional detergent bars of fatty acid salt type soaps have the following disadvantages.

(a) The pH of the detergent compositions at the concentration when it is used for personal cleanlines is high (i.e. pH=10–11).

(b) Water-insoluble scum is formed when the detergent compositions are used in hard water and, therefore, detergency and foaming (or lathering) power are remarkably impaired.

Furthermore, it is better for the skin that solid detergent compositions for body washing are weakly acidic. However, there is a problem in that the fatty acid salt type soap is liable to hydrolyze in an acidic condition.

In order to obviate the above-mentioned disadvantage (b), various attempts, such as the addition of a chelating agent and scum dispersant, have been made in the prior arts to improve hard water resistance and to prevent the formation of scum. However, satisfactory results still have not been obtained in the prior arts. Thus, as long as fatty acid salt type soap continues to be used, the above-mentioned disadvantages will remain.

Various synthetic anionic surface active agents are used as detergents for washing clothes, pots and dishes and for shampooing human hair. Of these synthetic anionic surface active agents, those which can be used under weak acidic condition and which have an excellent hard water resistance and do not cause the formation of scum are available at reasonable cost. Examples of such synthetic anionic surface active agents are alkylbenzene sulfonates and linear alpha-olefin sulfonates. However, since the alkylbenzene sulfonates are very difficult to dry and also since the dry alkylbenzene sulfonates are in a soft solid state, the use of alkylbenzene sulfonates as a raw material in the production of solid detergent compositions is not desirable. On the other hand, linear alpha-olefin sulfonates (which are sometimes referred to "AOS salts") is preferable for use as a raw material in the production of synthetic solid detergent compositions, since the linear alpha-olefin sulfonates have the following advantages.

(i) AOS salts are stable under a weak acidic condition.

(ii) AOS salts have an excellent detergency and foaming power even in hard water and do not cause the formation of scum.

(iii) AOS salts do not irritate human skin, as compared with other synthetic anionic surface active agents.

(iv) AOS salts can be readily dried and are available at a relatively low cost.

However, these linear alpha-olefin sulfonates have disadvantages in that solid detergent composition formed by useing, as a main ingredient, linear alpha-olefin sulfonates have high slough loss and high wear rate. Although the problems of these slough loss and wear rate are common to synthetic anionic detergent compositions, the extents of slough loss and wear rate are remarkable in the case of linear alpha-olefin sulfonates due to the fact that AOS salts have strongly hydrophilic sulfonate groups and double bonds.

The solid detergent compositions for personal hygiene are naturally stored for a long time in a bath room at a high temperature and a high humidity and are always in contact with water or moisture. In the case where solid detergent bars having high slough loss are laid under these conditions, the surface of the detergent bars becomes too soft due to the absorption of a large amount of water and, therefore, the detergent bars cannot be used for personal hygiene any more. In extreme cases, the detergent bars crack or crumble in such a manner that substantially no original form remains. In addition, solid detergent compositions having high wear rate are very rapidly used up and, further, when the solid detergent compositions in the form of bars are rubbed on a face towel, rinsing of the face towel becomes difficult due to the fact that a large amount of detergent compositions stick to the towel. Consequently, low slough loss and low wear rate are essential for solid detergent compositions. Recently, solid detergent compositions containing, as a base, sodium lauryl sulfate, N-long chain acyl acidic amino acid salts or the like have become commercially available. However, slough loss and wear rate of these detergent compositions are higher than conventional fatty acid salt type soaps.

Accordingly, an object of the present invention is to obviate the above-mentioned disadvantages of the prior arts and to provide a solid detergent composition, suitable for use in personal hygiene, having both extremely low slough loss and wear rate characteristics.

Other objects and advantages of the present invention will be apparent from the description set forth hereinbelow.

In accordance with the present invention, there is provided a solid detergent composition comprising;

(A) 40 to 89.9% by weight of at least one linear alpha-olefin sulfonate having 12 to 28 carbon atoms, (B) 10 to 60% by weight of at least one tertiary amine oxide having general formulae (I) and (II)

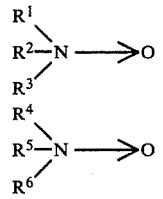

(I)

(II)

wherein $R^1$ represents an alkyl group having 16 to 24 carbon atoms, $R^2$ represents an alkyl group having 1 to 11 carbon atoms, $R^3$ represents an alkyl group having 1 to 3 carbon atoms, $R^4$ and $R^5$ independently represent an alkyl group having 12 to 24 carbon atoms and $R^6$ represents an alkyl group having 1 to 3 carbon atoms, and (C) 0.1 to 20% by weight of water.

Figure 2:
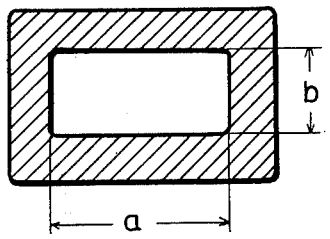

The present invention will be better understood from the following description in connection with the accompanying drawings in which:

FIG. 1 is a schematic cross-sectional view illustrating a dipped condition of a test sample under slough test, and FIG. 2 is a front view illustrating the dipped surface of a sample after a slough test.

The solid detergent compositions according to the present invention have the above-mentioned advantages of AOS salts, that is, good stability in an acidic condition, excellent hard water resistance and non-irritation of human skin. Furthermore, according to the present invention, the above-mentioned big disadvantages of AOS salts (i.e. high slough loss and high wear rate) can be effectively overcome.

The component (A) (i.e. water-soluble salts of linear alpha-olefin sulfonic acid having 12 to 28 carbon atoms) used in the present invention, can be prepared, in any conventional manner, from a starting alpha-olefin having 12 to 28 carbon atoms or mixtures thereof. For instance, the starting alpha-olefin is first sulfonated by using sulfur trioxide or the like, and the sulfonated products are neutralized with an appropriate basic substance, for example alkali metal hydroxides, such as sodium hydroxide, potassium hydroxide and the like, alkaline earth metal hydroxides, such as magnesium hydroxide and the like, aqueous ammonia and alkanol amines, such as monoethanol amine and triethanol amine and; then, the neutralized products are hydrolyzed. Thus, the alkali metal salts, the alkaline earth metal salts, the alkanol amine salts, of linear alpha-olefin sulfonic acid having 12 to 28 carbon atoms can be obtained. The salts of linear alpha-olefin sulfonic acids obtained by using, as a sulfonating agent, chlorosulfonic acid or the like can be employed in the present invention.

As mentioned above, the component (A) should be present in an amount of 40 to 89.9% by weight, preferably 50 to 70% by weight, based on the weight of the present solid detergent composition. In the case where the content of the component (A) in the solid detergent composition is less than 40% by weight, the foaming power is impaired in personal hygiene use. Contrary to this, in the case where the content of the component (A) is more than 89.9% by weight, the slough loss and the wear rate are increased together.

The component (B) (i.e. tertiary amine oxides having the above mentioned formula (I) or (II)) used in the present invention should contain, as alkyl groups bonded to nitrogen atom, one long chain alkyl group of 16 to 24 carbon atoms or two long chain alkyl groups of 12 to 24 carbon atoms. In a case where the chain length of the long chain alkyl group or groups is shorter than the above-mentioned length, the manufacture of the solid detergent compositions in the form of bars becomes difficult due to the fact that the mixture thereof with the AOS salts is soft and the surface of the manufactured bars becomes sticky with the lapse of time due to the fact that the compositions are hygroscopic.

Typical examples of the component (B) used in the present invention are dimethylhexadecylamine oxide, methyldioctadecylamine oxide, dimethyloctadecylamine oxide, dimethyleicosylamine oxide, methyldidodecylamine oxide, methyldieicosylamine oxide and the like. These tertiary amine oxides may be used alone or in any combination thereof in the present solid detergent compositions.

As mentioned above, the component (B) should be present in an amount of 10 to 60% by weight, preferably 15 to 40% by weight, based on the weight of the present solid detergent composition. In the case where the content of the component (B) in the solid detergent composition is less than 10% by weight of the present solid detergent composition the slough loss and wear rate characteristics cannot be effectively improved, as compared with the conventional synthetic anionic detergent compositions. Contrary to this, in the case where the content of the component (B) is more than 60% by weight, it is not desirable that the foaming power is decreased.

In order to form the present solid detergent composition into the form of, for example, bars, the present solid detergent composition should contain 0.1 to 20% by weight, preferably 0.1 to 10% by weight, of water. The composition is plasticized by the addition of water and, as a result, the operation of roll milling, prodder extruding and stamp molding are facilitated. The amount of water to be incorporated into the present solid detergent composition may be varied by the types and the compounding amounts of the components (A) and (B) and other optional components set forth below. However, in the case where the amount of water in the solid detergent composition is more than 20% by weight, it is not preferably that the composition becomes soft and the molding of the composition into the desired form becomes difficult.

So long as the above-mentioned requirements are satisfied, other conventional additives can optionally be incorporated into the present solid detergent compositions. Examples of such optional additives are: humectants such as glycerine, propyleneglycol and polyethyleneglycol; superfatting agents such as fatty acid, fatty alcohol and lanolin; foam (or lather) boosters such as cocoyl fatty acid diethanol amide and glyceryl monolaurate; disinfectants such as hexachlorophene, 3-trifluoromethyl-4,4'-dichlorocarbanilide and 2,4,4'-trichloro-2'-hydroxydiphenyl ether; anti-oxidants such as BHT and tocopherol; pigments such as titanium dioxide, talc and kaolin; pH adjusting agents such as citric acid, malic acid and phosphoric acid; perfumes; dyes; and the like.

The solid detergent composition of the present invention can be prepared in any conventional manner. For instance, the above-mentioned components (A) and (B) and, if necessary, the above-mentioned one or more optional components are mixed with each other in the presence of water. The mixing may be carried out at an elevated temperature (e.g. 50°–80° C.), if necessary. After thoroughly mixing, the mixture is dried. The resultant mixture is generally milled, extruded and, then, stamped by using a roll mill and a prodder according to a so-called milling method. In addition, a so-called framing method can also be used in the production of the present solid detergent composition.

This invention now will be further illustrated by, but is by no means limited to, the following Examples.

The molded samples of the solid detergent compositions obtained in the Examples and Comparative Examples below were evaluated. The test methods employed in these evaluation are as follows.

(1) Slough Loss Test

A solid detergent sample 11 having dimensions of 5.5 cm×3.5 cm×1.0 cm are dipped in a plastic vessel 12 having dimensions of 9 cm×7 cm×3 cm, and containing 10 ml of water 13 for 30 minutes at a temperature of 25° C. After dipping, the sample is placed on a filter paper and dried for 30 minutes. The dipping and the subsequent drying operation is further repeated 5 times. The dipping portion of a sample 11 having a remarkable slough loss is attached by water, whereby the sample is deformed into form 11 as shown in FIG. 1.

After drying, the sloughing state is visually observed and the rate of decrease in area (i.e. the rate of the area of the oblique lined portion of FIG. 2 to the total cross-sectional area) is determined by the following equation.

$$\text{Rate of Decrease in Area [\%]} = \frac{5.50 \times 3.50 - a \times b}{5.50 \times 3.50} \times 100$$

In the case where the rate of decrease in the area according to the equation comes out is a positive entity a portion of the detergent sample can be dissolved in water. Contrary to this if the rate of decrease in the area computed according to the above equation is a negative entity, the sample becomes swelled.

On the other hand, the sloughing state of the sample is visually observed according to the following rating in which commercially available sodium N-acyl glutamate is used as a standard sample.

++: Excellent
+: Good
±: Equal
−: Poor
−−: Bad (2) Wear Rate Test

Wear rate of a sample is determined by a method according to JIS (Japanese Industrial Standard) K-3304.

(3) Foaming Test

A sample having dimensions of 5.5 cm×3.5 cm×1.0 cm is prepared and the foaming power thereof is comparatively tested, through hand washing with that of commercially available bars of soap containing, as a base, sodium N-acyl glutamate. The foaming power is evaluated according to the following rating in which sodium N-acyl glutamate soap is used as a standard.

+: Good
±: Equal
−: Poor

EXAMPLES 1 to 8 and COMPARATIVE EXAMPLES 1 to 9

Linear alpha-olefins having 14 to 18 carbon atoms were sulfonated with sulfur trioxide diluted with air by using a continuous thin-film type sulfonation reactor. Then, the sulfonated products were neutralized and hydrolyzed with sodium hydroxide, whereby a sodium alpha-olefin sulfonate (AOS-Na salt) slurry was obtained. This slurry was spray-dried to form AOS-Na salt powder.

270 g of the AOS-Na salt powder was thoroughly admixed with 480 g of a 25% by weight aqueous solution of dimethyloctadecylamine oxide. The mixture was then dried with hot air until the water content of the mixture became approximately 5% by weight. Subsequently, the dried product was thoroughly milled by using a small roll mill and was extruded by using a small prodder to form, rod-like extrudate. Thereafter, the solid detergent composition of Example 1 in the form of bars was molded. The water content of the molded bars was 3%.

The molded solid detergent compositions of Examples 2 to 8 and Comparative Examples 1 to 9 were prepared in a manner as described in Example 1. The composition of each solid detergent composition is listed in Table 1 below and the test results of the slough loss, the wear rate and the foaming are shown in Table 2 below.

TABLE 1

(% by weight)

| | Examples | | | | | | | | Comparative Examples | | | | | | | | |
|---|---|---|---|---|---|---|---|---|---|---|---|---|---|---|---|---|---|
| | 1 | 2 | 3 | 4 | 5 | 6 | 7 | 8 | 1 | 2 | 3 | 4 | 5 | 6 | 7 | 8 | 9 |
| $C_{14}$–$C_{18}$ AOS—Na Salt | 67 | 67 | 67 | 67 | 67 | 67 | 42 | 85 | 95 | 67 | 67 | 67 | 32 | 92 | 67 | 67 | 67 |
| Dimethylhexadecylamine Oxide | — | 30 | — | — | — | — | — | — | — | — | — | — | 65 | 5 | — | — | — |
| Dimethyltetracosylamine Oxide | — | — | 30 | — | — | — | — | — | — | — | — | — | — | — | — | — | — |
| Methyldidodecylamine Oxide | — | — | — | 30 | — | — | — | — | — | — | — | — | — | — | — | — | — |
| Methyldihexadecylamine Oxide | — | — | — | — | 30 | — | — | — | — | — | — | — | — | — | — | — | — |
| Methyldioctadecylamine Oxide | — | — | — | — | — | 30 | — | — | — | — | — | — | — | — | — | — | — |
| Dimethyloctadecylamine Oxide | 30 | — | — | — | — | — | 55 | 12 | — | — | — | — | — | — | — | — | — |
| Dimethyldodecylamine Oxide | — | — | — | — | — | — | — | — | — | 30 | — | — | — | — | — | — | — |
| Dimethyltetradecylamine Oxide | — | — | — | — | — | — | — | — | — | — | 30 | — | — | — | — | — | — |
| Methyldidecylamine Oxide | — | — | — | — | — | — | — | — | — | — | — | 30 | — | — | — | — | — |
| Paraffin wax (130° F.) | — | — | — | — | — | — | — | — | — | — | — | — | — | — | 30 | — | — |
| Stearyl Alcohol | — | — | — | — | — | — | — | — | — | — | — | — | — | — | — | 30 | — |
| Stearic Acid | — | — | — | — | — | — | — | — | — | — | — | — | — | — | — | — | 30 |
| Water | 3 | 3 | 3 | 3 | 3 | 3 | 3 | 3 | 5 | 3 | 3 | 3 | 3 | 3 | 3 | 3 | 3 |

TABLE 2

| | Sloughing Property | | | |
|---|---|---|---|---|
| | Slough State | Rate of Decrease in Area (%) | Wear Rate | Foaming |
| Example | | | | |
| 1 | ++ | −4 | 28 | + |
| 2 | ++ | −4 | 49 | + |
| 3 | ++ | −4 | 31 | + |
| 4 | ++ | −1 | 42 | + |
| 5 | ++ | −1 | 38 | + |
| 6 | ++ | −2 | 32 | + |
| 7 | + | −6 | 35 | ± |
| 8 | + | 5 | 40 | + |
| Comparative Example | | | | |
| 1 | −− | 25 | 55 | + |
| 2 | Sample could not be molded. | | | |

TABLE 2-continued

| | | Sloughing Property | | | |
|---|---|---|---|---|---|
| | | Slough State | Rate of Decrease in Area (%) | Wear Rate | Foaming |
| | 3 | | " | | |
| | 4 | | " | | |
| | 5 | −*1 | −10 | 30 | − |
| | 6 | −− | 19 | 53 | + |
| | 7 | ± | 12 | 54 | + |
| | 8 | ± | 18 | 50 | + |
| | 9 | −− | 28 | 84 | + |
| Commercially Available product | Sodium N-acyl-glutamate Base | ± | −6 | 64 | ± |
| | Sodium Laurylsulfate base | −− | 20 | 68 | + |
| | Sodium Fatty Acid Type Soap*2 | ++ | −1 | 45 | + |

*1Sample was remarkably swelled and the water-absorbed portions soon became jelly.
*2coconut/tallow = ¼ (by weight)

The following is clear from the results shown in Table 2:

(1) The solid compositions, containing the amine oxides, of Examples 1 to 6 according to the present invention have remarkably improved slough loss and wear rate, as compared with the sample of Comparative Example 1 which only the AOS-Na salt is contained.

(2) In the case where the chain lengths of the alkyl groups of the tertiary amine oxides are shorter than the above-specified lower limit of the present invention, as shown in Comparative Examples 2 to 4, the mixtures thereof with the AOS-Na salts become soft so that the mixtures cannot be molded into a desired form.

(3) The compounding amount of the tertiary amine oxide should be within the range of 10 to 60% by weight, as shown in Examples 7 and 8. In the case where the compounding amount of the tertiary amine oxide is less than the above-mentioned range, as shown in Comparative Example 6, the slough loss of the composition is remarkably high and the wear rate also becomes high. On the other hand, in the case where the compounding amount of the tertiary amine oxide is more than the above-mentioned range, as shown in Comparative Example 5, the composition becomes remarkably swelled and the water-absorbed portions thereof become jelly, and further, the foaming property of the composition becomes bad.

(4) In comparative Examples 7 to 9, known slough preventing agents (i.e. solid paraffin, stearyl alcohol and stearic acid) are incorporated into the compositions. However, desirable effects cannot be obtained by the addition of solid paraffin and stearyl alcohol and the addition of stearic acid rather adversely affects the sloughing property of the composition. As is clear from the results of Comparative Examples 7 to 9, the effects of the present invention is far superior to those obtained by the incorporation of the known slough preventing agent.

(5) As is clear from the comparison with the test results of the commercially available products, according to the present invention, the sloughing property of the AOS-Na salts, which is inferior to that of the commercially available products containing, as a base, sodium N-acyl glutamate and sodium laurylsulfate, can be remarkably improved to such an extent that the sloughing property of the AOS-Na salt is superior to that of said commercially available products. Furthermore, the sloughing property and the wear rate characteristics of the present solid detergent compositions are at least comparative to those of the conventional fatty acid salt type soap.

EXAMPLE 9

A solid detergent composition having the composition shown below was prepared in a manner as described in Example 1.

| Composition | % by weight |
|---|---|
| $C_{14}$–$C_{18}$ AOS—Na Salts | 69 |
| Dimethylhexadecylamine Oxide | 10 |
| Methyldioctadecylamine Oxide | 15 |
| Perfume | 1 |
| Water | 5 |
| | 100 |

When a mixture of the tertiary amine oxides was used, it was observed that good results similar to those of the above-mentioned Examples were obtained.

EXAMPLE 10

A solid detergent composition having the composition shown below was prepared in a manner as described in Example 1.

| Composition | % by Weight |
|---|---|
| $C_{16}$–$C_{18}$ AOS—Na Salts | 64 |
| Diethyloctadecylamine Oxide | 25 |
| Citric Acid | 3 |
| Perfume | 1 |
| Water | 7 |
| | 100 |

When citric acid (i.e. PH adjustor) was incorporated into the present solid detergent composition, it was observed that good results similar to those of the above-mentioned Examples were obtained.

EXAMPLE 11

A solid detergent composition having the composition shown below was prepared in a manner as described in Example 1.

| Composition | % by weight |
|---|---|
| $C_{14}$–$C_{18}$ AOS—Na Salts | 17 |
| $C_{20}$–$C_{28}$ AOS—Na Salts | 41 |

-continued

| Composition | % by weight |
|---|---|
| Methyldihexadecylamine Oxide | 18 |
| Cetanol | 12 |
| Glycerin | 5 |
| Perfume | 1 |
| Water | 6 |
| | 100 |

When Cetanol (i.e. superfatting agent) was used, it was observed that good results similar to those of the above-mentioned Examples were obtained.

EXAMPLE 12

A solid detergent composition having the composition shown below was prepared according to a so-called framing method.

| Composition | % by weight |
|---|---|
| $C_{14}$ AOS—Na Salt | 54 |
| Methyldioctadecylamine Oxide | 20 |
| Paraffin wax | 10 |
| Perfume | 1 |
| Water | 15 |
| | 100 |

When the solid detergent composition was prepared by using framing method, it was observed that good results similar to those of the above-mentioned Examples were obtained.

I claim:

1. A solid detergent composition comprising:

(A) 40 to 89.9% by weight of at least one linear alpha-olefin sulfonate having 12 to 28 carbon atoms, (B) 10 to 60% by weight of at least one tertiary amine oxide having general formulae (I) and (II)

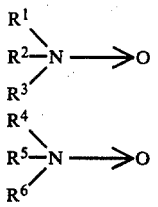

(I)

(II)

wherein $R^1$ represents an alkyl group having 16 to 24 carbon atoms, $R^2$ represents an alkyl group having 1 to 11 carbon atoms, $R^3$ represents an alkyl group having 1 to 3 carbon atoms, $R^4$ and $R^5$ independently represent an alkyl group having 12 to 24 carbon atoms and $R^6$ represents an alkyl group having 1 to 3 carbon atoms, and (c) 0.1 to 20% by weight of water.

2. A solid detergent composition as claimed in claim 1, wherein said composition comprises;

(A) 50 to 70% by weight of said linear alpha-olefin sulfonate, (B) 15 to 40% by weight of said tertiary amine and (C) 0.1 to 10% by weight of water.

* * * * *